US010220617B2

(12) United States Patent
Yamazaki et al.

(10) Patent No.: US 10,220,617 B2
(45) Date of Patent: Mar. 5, 2019

(54) LIQUID DISCHARGE HEAD AND LIQUID DISCHARGE APPARATUS

(71) Applicant: CANON KABUSHIKI KAISHA, Tokyo (JP)

(72) Inventors: Takuro Yamazaki, Inagi (JP); Yoshiyuki Nakagawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/644,590

(22) Filed: Jul. 7, 2017

(65) Prior Publication Data

US 2018/0015723 A1 Jan. 18, 2018

(30) Foreign Application Priority Data

Jul. 12, 2016 (JP) ..... 2016-137371

(51) Int. Cl.
*B41J 2/14* (2006.01)

(52) U.S. Cl.
CPC ..... *B41J 2/14201* (2013.01); *B41J 2/1404* (2013.01); *B41J 2/14032* (2013.01); *B41J 2/14112* (2013.01); *B41J 2002/14467* (2013.01); *B41J 2202/12* (2013.01)

(58) Field of Classification Search
CPC ..... B41J 2/14112; B41J 2/14032
See application file for complete search history.

(56) References Cited

U.S. PATENT DOCUMENTS 8,308,275 B2 11/2012 Xie
9,138,995 B2 * 9/2015 Mizutani ..... B41J 2/1404

* cited by examiner

*Primary Examiner* — Juanita D Jackson
(74) *Attorney, Agent, or Firm* — Canon U.S.A., Inc. IP Division

(57) ABSTRACT

A liquid discharge head includes a print element substrate provided with a plurality of energy generation elements configured to apply energy for discharging a liquid, a discharge port forming member provided with a plurality of discharge ports which face the energy generation elements and are configured to discharge the liquid, and a plurality of first partitions which extend between the print element substrate and the discharge port forming member, and are configured to partition pressure chambers including the energy generation elements.

18 Claims, 14 Drawing Sheets

LIQUID DISCHARGE HEAD AND LIQUID DISCHARGE APPARATUS

BACKGROUND OF THE INVENTION

Field of the Invention

The present disclosure relates to a liquid discharge head and a liquid discharge apparatus.

Description of the Related Art

In recent years, in pursuing higher image quality of a liquid discharge head, there has been a demand for highly densely disposing discharge ports that can discharge micro droplets to stably achieve high-quality printing at high speed for a prolonged period of time. To achieve such high-quality printing at high speed, a number of long liquid discharge heads having a width equal to or larger than that of a recording medium are employed.

A long liquid discharge head has tendency that the number of discharge ports subjected to liquid discharge control increases in proportion to the width of the liquid discharge head and that the number of discharge port rows increases with increasing printing resolution and increasing number of colors of the liquid to be used. Variations in the amount of droplets and the discharge direction of the liquid to be discharged from the discharge ports lead to degraded quality of printed characters and images.

U.S. Pat. No. 8,308,275 discusses a liquid discharge head provided with a pair of liquid supply ports for each discharge port and configured to circulate a liquid between pair of the liquid supply ports. Since the liquid in a pressure chamber is replaced through liquid circulation, it is possible to prevent the concentration of the liquid and variations in liquid surface level in the discharge port caused by the volatilization of the liquid from the discharge port.

To print high-quality characters and images at high speed, it is necessary that micro droplets are repeatedly discharged in a desired direction at high frequency and land at a desired position on a recording medium. To control the discharge amount of micro droplets, reducing the volume of the pressure chamber is effective. Reducing the volume of the pressure chamber enables efficiently directing the liquid discharge pressure applied by an energy generation element toward the outside of the discharge port, and discharging the controlled amount of liquid from the discharge port at a required discharge velocity.

On the other hand, in particular, the volatilization of the liquid from the discharge port largely affects the accuracy in the discharge amount and discharge direction of droplets to be discharged first. The progress of the volatilization of the liquid may increase the liquid density in the vicinity of the discharge port or increase dents on the liquid surface in the discharge port, possibly reducing the discharge amount and causing non-discharging. In this case, even if the liquid is discharged, the liquid may not be correctly discharged in the desired direction. To stably discharge the liquid, it is desirable to minimize variations in liquid density and liquid surface in the vicinity of the discharge port.

A liquid discharge head discussed in U.S. Pat. No. 8,308,275 is provided with a liquid circulation mechanism. However, since the flow passage from the liquid supply port to the energy generation element is not optimized, the flow velocity distribution may become nonuniform or a vortex may occur in the flow passage. In particular, a disturbance of the liquid flux vector in the pressure chamber will cause a disturbance of droplets discharged from the discharge port. Smaller droplets degrade the discharge direction accuracy according to the degree of the disturbance of the liquid flux vector to a further extent. As a result, the landing accuracy of droplets discharged from the discharge port degrades, possibly leading deterioration in the quality of printed characters and images.

SUMMARY OF THE INVENTION

The present disclosure is directed to a liquid discharge head having a more uniform flow velocity distribution of the liquid in the pressure chamber.

According to the present disclosure, a liquid discharge head includes a print element substrate provided with a plurality of energy generation elements configured to apply energy for discharging a liquid, discharge port forming member provided with a plurality of discharge ports which face the energy generation elements and are configured to discharge the liquid, and a plurality of first partitions extending between the print element substrate and the discharge port forming member. The plurality of first partitions forms a plurality of pressure chambers each of which includes an energy generation element. The plurality of energy generation elements is disposed in a first direction on a first surface of the print element substrate. A ratio of a separation distance between the first partitions in the first direction to the height of the pressure chambers in a direction perpendicular to the first surface is 4 or above.

Further features of the present disclosure will become apparent from the following description of exemplary embodiments with reference to the attached drawings.

DESCRIPTION OF THE EMBODIMENTS

Figure 1:
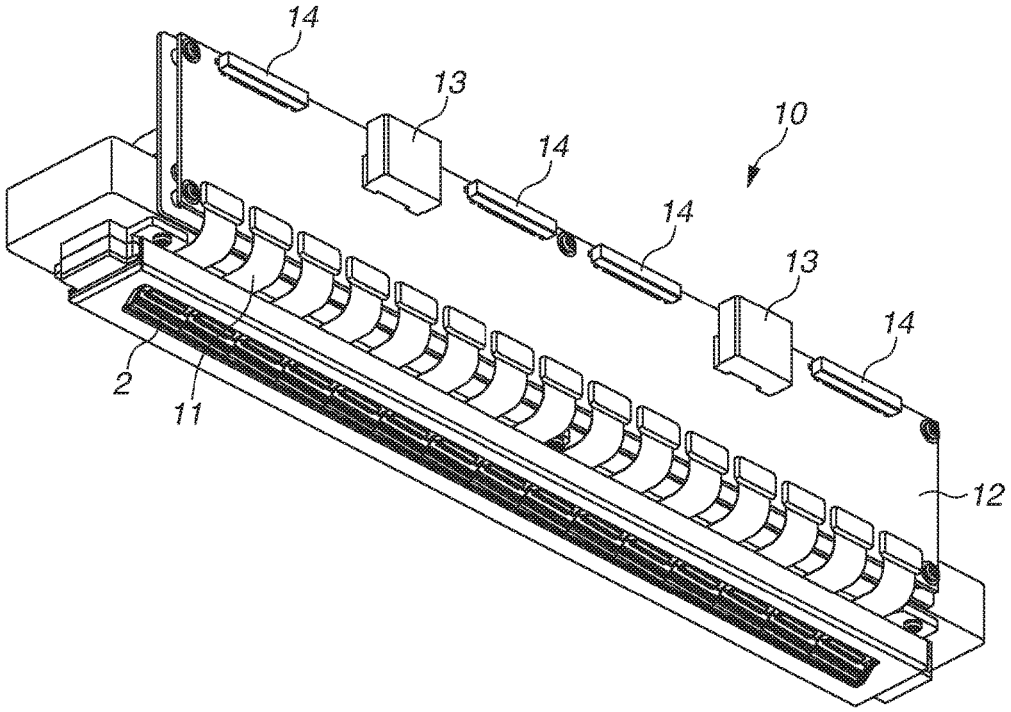
FIG. 1 is a perspective view schematically illustrating an example of a liquid discharge head according to the present disclosure.

A plurality of exemplary embodiments according to the present disclosure will be described below with reference to the accompanying drawings. The following exemplary embodiments do not limit the scope of the present disclosure. Although the present exemplary embodiment relates to a liquid discharge head for discharging ink, the liquid to be discharged is not limited to ink. Although the present exemplary embodiment employs a thermal method for generating air bubbles with the heat generated by energy generation elements and discharging a liquid, a piezoelectric method and other various liquid discharge methods are also applicable to the present disclosure.

The liquid discharge head according to the present exemplary embodiment is a long line-type head having a length corresponding to the width of a recording medium. However, the present disclosure also includes a serial-type liquid discharge head for performing recording while scanning a recording medium. A serial type liquid discharge head includes, for example, a print element substrate for black ink and a print element substrate for color ink. Several print element substrates can also be disposed so that the discharge ports of an adjoining print element substrate overlap in the discharge port arranging direction. The present disclosure also includes a short line head which has a length shorter than the width of a recording medium and performs recording while scanning a recording medium.

The liquid discharge head according to the present exemplary embodiment has at least four rows of discharge ports. The four rows are supplied respectively with cyan, magenta, yellow, and black (CMYK) ink from an ink tank. This configuration enables the liquid discharge head according to the present exemplary embodiment to perform full color printing. The rows of discharge ports for discharging CMYK ink can be formed either on the same print element substrate or on different print element substrates. In the latter case, a liquid discharge head can be configured by arranging print element substrates for discharging ink of respective colors.

In the following descriptions, the direction in which a plurality of energy generation elements and a plurality of discharge ports are disposed is referred to as a first direction W. The direction which is parallel to the first surface of the print element substrate on which a plurality of energy generation elements is disposed, and perpendicularly intersects with the first direction W is referred to as a second direction D. The second direction D is the same as the direction of the ink flow passage in the pressure chamber. The direction perpendicular to the first surface, i.e., the direction perpendicularly intersecting with the first direction W and the second direction D is referred to as a third direction H. Unless otherwise noted, the terms "width", "length", and "height" mean the dimensions in the first direction W, the second direction D, and the third direction H, respectively.

A first exemplary embodiment will be described below. FIG. 1 is a perspective diagram schematically illustrating a liquid discharge head 10 according to the first exemplary embodiment of a liquid discharge apparatus according to the present disclosure. The liquid discharge head 10 has a printing width of 300 mm which is longer than the length of the long side of an A4-size recording medium. A discharge port row is formed by arranging in series a plurality of print element substrates each of which is composed of 256 to 2048 discharge ports or above per unit.

The liquid discharge head 10 includes at least print element substrates 2, flexible wiring substrates 11, an electrical wiring substrate 12 electrically connected to the flexible wiring substrates 11, electrical power supply terminals 13 for supplying power for ink discharge control, and signal input terminals 14 for supplying electrical signals for ink discharge control. The electrical power supply terminals 13 and the signal input terminals 14 are connected with a printing control circuit (not illustrated) of the liquid discharge apparatus. Ink is supplied from the ink tank (not illustrated) to a pressure chamber 4 of the liquid discharge head 10 through capillarity or by using a pump. According to other exemplary embodiments, two ink tanks are disposed respectively on the upstream and the downstream sides of the liquid discharge head 10, and ink flows from one ink tank to the other, thereby being supplied to the pressure chamber 4.

Figure 2A:
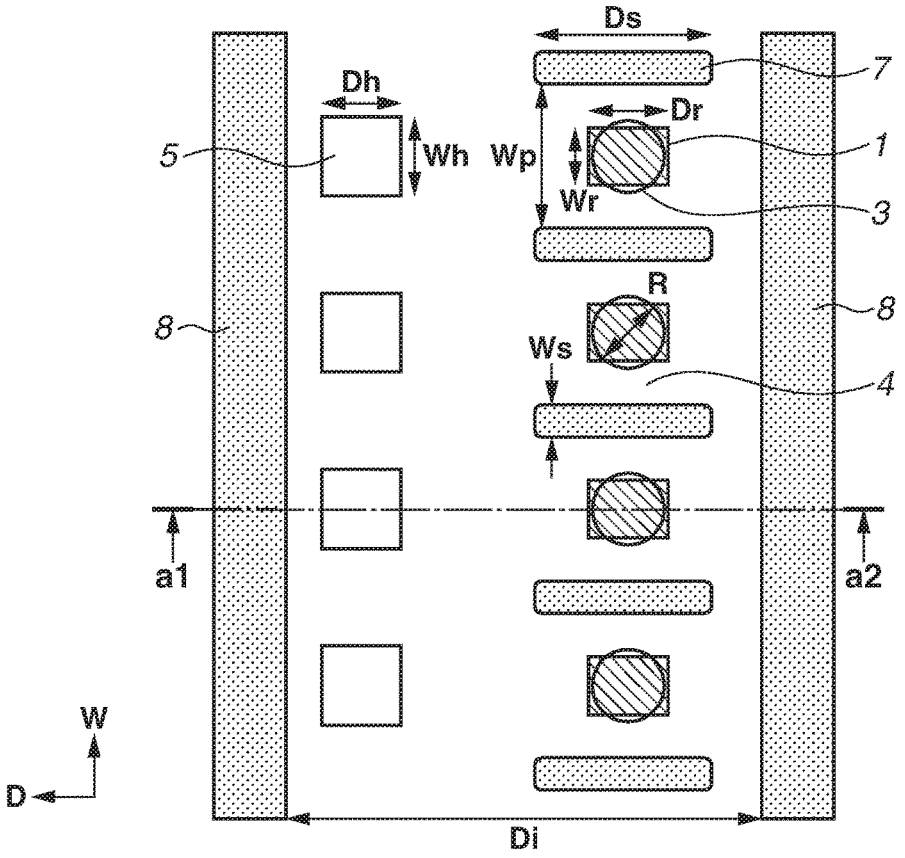
FIGS. 2A and 2B are schematic views illustrating a print element substrate according to a first exemplary embodiment of the present disclosure.
Figure 2B:
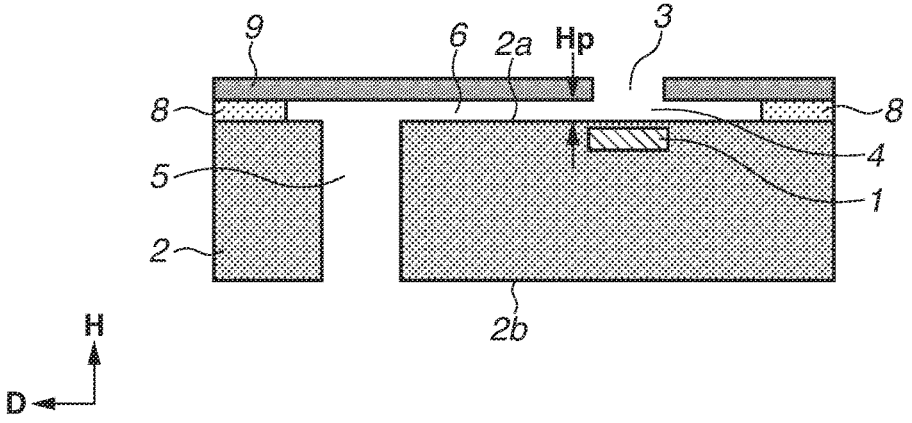

FIGS. 2A and 2B are enlarged schematic views illustrating a part of the print element substrate 2. FIG. 2A is a plan view illustrating the print element substrate 2 and illustrating the internal pressure chambers 4. FIG. 2B is a sectional view taken along the line a1-a2 illustrated in FIG. 2A. The print element substrate 2 has a first surface 2*a* and a second surface 2*b* on the opposite side of the first surface 2*a*. The first surface 2*a* is provided with a plurality of energy generation elements 1 for applying energy for discharging ink. A discharge port forming member 9 has a plurality of discharge ports 3 at positions facing the energy generation elements 1. The discharge ports 3 are disposed with an arrangement density of 600 dots per inch (dpi).

Two side walls 8 extending in the first direction W along the long side of the print element substrate 2 and a plurality of first partitions 7 extending in the direction (second direction D) parallel to the short side of the print element substrate 2 are disposed between the print element substrate 2 and the discharge port forming member 9. The two side walls 8 and the plurality of first partitions 7 are integrally formed with the discharge port forming member 9 so that the discharge port forming member 9 is fixed to the print element substrate 2. A plurality of pressure chambers 4 each of which includes one energy generation element 1 is formed between the print element substrate 2 and the discharge port forming member 9. The pressure chamber 4 is partitioned by the print element substrate 2, the discharge port forming member 9, and the adjacent first partitions 7. The pressure chamber 4 is a space containing the energy generation element 1. In a broad sense, the pressure chamber 4 is a region in which pressure acts when the energy generation element 1 is driven. The dimension of the pressure chamber 4 according to the present exemplary embodiment are equal to a distance Wp between the adjacent first partitions 7 in the first direction W, and are equal to a length Ds of the first partition 7 in the second direction D. The dimension of the pressure chamber 4 in the third direction H are equal to the distance between the print element substrate 2 and the discharge port forming member 9 or the height of the side walls 8. The length Ds of the first partition 7 is larger than the dimension Dr of the energy generation element 1 in the second direction D. The first partition 7 is closer to a first communication hole 5 (described below) than the energy generation element 1 in the second direction D. As a result, ink flows through a part on the entrance side of the pressure chamber 4 in the second direction D and reaches the vicinity of the energy generation element 1. A liquid flow passage 6 connected to the pressure chamber 4 and the first communication hole 5 to supply ink to the pressure chamber 4 is formed between the pressure chamber 4 and the first communication hole 5.

The first communication hole 5 for supplying ink is formed to penetrate the print element substrate 2 from the first surface 2*a* to the second surface 2*b*. The pressure chamber 4 is connected to the first communication hole 5 via the liquid flow passage 6. A pillar-shaped filter (not illustrated) for preventing foreign substances from entering the pressure chamber 4 may be installed in the liquid flow passage 6. However, to prevent the disturbance of the flow of ink in the pressure chamber 4, it is desirable to minimize the dimensions of the opening of the filter, more specifically, the opening is desirably smaller than at least the diameter of the discharge port 3.

The ink stored in an ink tank (not illustrated) is supplied to the pressure chamber 4 via a common flow passage (not illustrated) disposed on the side of the second surface 2*b* of the print element substrate 2, the first communication hole 5, and the liquid flow passage 6. The energy generation element 1 is electrically connected with the electrical wiring substrate 12 via an electrical wiring provided inside the print element substrate 2 and terminal provided on the surface of the print element substrate 2. The energy generation element 1 generates heat based on a pulse signal input from the printing control circuit to boil ink. When ink foams on the energy generation element 1, a foaming pressure is generated in the pressure chamber 4, and the foaming pressure discharges ink from the discharge port 3 in the third direction H. After ink is discharged, the pressure chamber 4 is filled up with new ink via the liquid flow passage 6.

To stably discharge a fixed amount of ink droplets from the discharge port 3 in the third direction H, it is desirable that variations in the flow velocity of ink in the first direction W are small on the energy generation element 1 and that the foaming pressure in the pressure chamber 4 is uniformized at least on the energy generation element 1. To achieve this condition, it is desirable that the flow velocity of ink in the second direction D is more uniform that in the first direction W or zero in the pressure chamber 4. However, at the time of high-speed printing, since ink discharge from the discharge port 3 and ink supply to the pressure chamber 4 are repeated at high speed, it is difficult to control the flow velocity of ink to be constant on the energy generation element 1 during ink foaming. Therefore, a disturbance of the flow velocity of ink is likely to occur when ink is being replenished in the pressure chamber 4. According to the present exemplary embodiment, the disturbance of the flow velocity of ink can be prevented by optimizing the shape of the pressure chamber 4.

Figure 3:
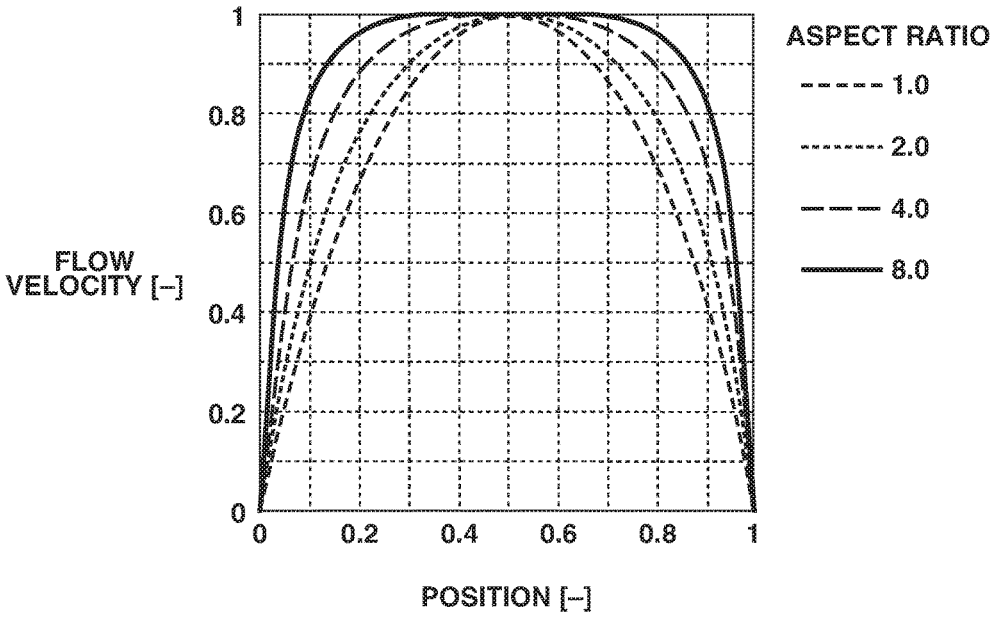
FIG. 3 illustrates a relation between an aspect ratio of a pressure chamber and a flow velocity distribution.

FIG. 3 illustrates a relation between the position of the pressure chamber 4 in the first direction W and the flow velocity distribution of ink by using the aspect ratio of the pressure chamber 4 as a parameter. The flow velocity distribution of ink is a distribution in the first direction W of the flow velocity of ink in the second direction D of the pressure chamber 4 in a section of the pressure chamber 4 which passes through the center of the discharge port 3, perpendicularly intersects with the first surface 2*a*, and is parallel to the first direction W. The aspect ratio of is a ratio (Wp/Hp) of the distance Wp between the adjacent first partitions 7 in the first direction W to a height Hp of the pressure chamber 4. The height Hp of the pressure chamber 4 means the dimension of the pressure chamber 4 in the third direction H and is equal to the distance between the print element substrate 2 and the discharge port forming member 9 in the third direction H or is equal to the height of the side walls 8. The horizontal axis denotes the normalized position of the pressure chamber 4 in the first direction W, and the vertical axis denotes the flow velocity of ink in the second direction D which is normalized with 1 as the maximum value. The increase in the aspect ratio of the pressure chamber 4 increases the influence of friction between ink and the wall surface, and, as a result, expands the range in which the flow velocity distribution in the pressure chamber 4 is uniformized in the first direction W. In other words, to obtain a more uniform flow velocity distribution of ink in the first direction W in the pressure chamber 4, it is desirable that the pressure chamber 4 has a larger aspect ratio.

Figure 4A:
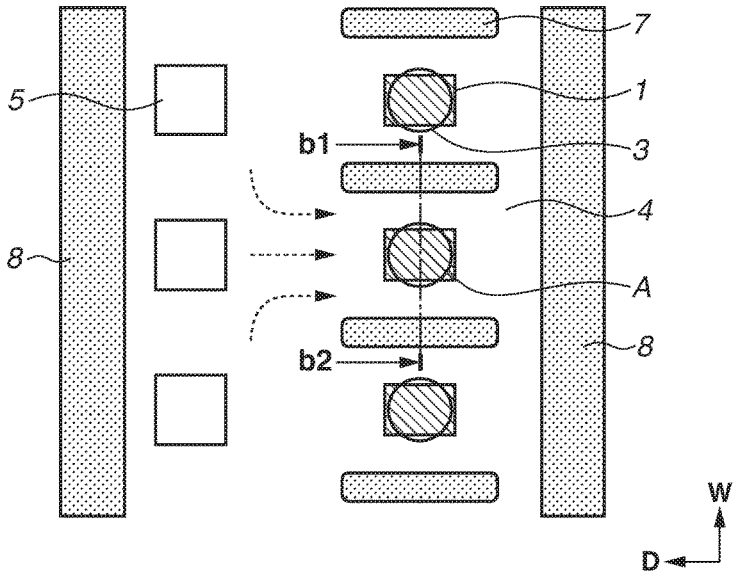
FIGS. 4A to 4C are schematic views illustrating a flow of ink in the vicinity of the pressure chamber and the flow velocity distribution of ink in the pressure chamber.
Figure 4B:
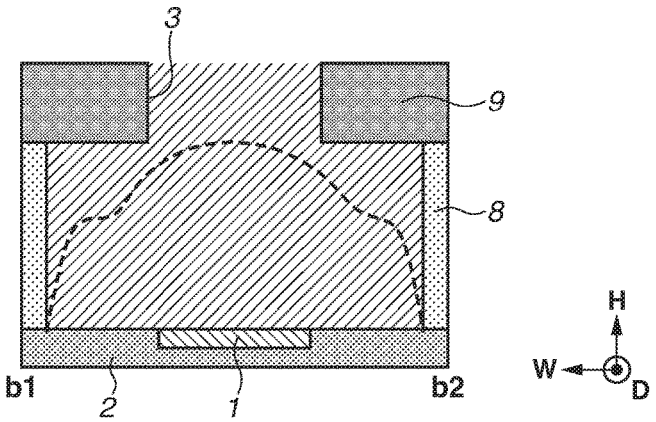
Figure 4C:
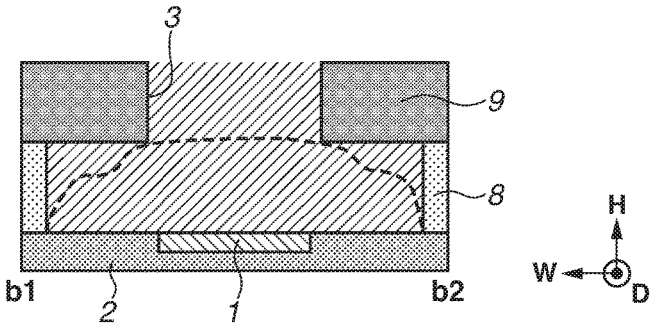

FIGS. 4A to 4C schematically illustrate the flow of ink in the pressure chamber 4 having a discharge port. A. In this case, it is assumed that ink is not discharged from other discharge ports 3 in the vicinity of the discharge port A. FIG. 4A is a plan view of the print element substrate 2, schematically illustrating the flow of ink supplied to the pressure chamber 4 after ink is discharged from the discharge port A. FIGS. 4B and 4C schematically illustrate the flow velocity of ink in the second direction D on the section of the pressure chamber 4 taken along the line b1-b2 illustrated in FIG. 4A as a function of the position in the first direction W. FIG. 4B illustrates a case where the aspect ratio of the pressure chamber 4 is 2.0, and FIG. 4C illustrates a case where the aspect ratio is 4.0.

After ink is discharged from the discharge port A, the pressure chamber 4 is refilled with ink through the liquid flow passage c from the first communication hole 5. In the configuration illustrated in FIG. 4A, since the pressure chamber 4 is not completely partitioned by the first partitions 7, ink is replenished in the pressure chamber 4 having the discharge port A not only from the first communication hole 5 facing the discharge port A but also from the first communication holes 5 adjacent to the first communication hole 5 facing the discharge port A. Therefore, at the entrance of the pressure chamber 4, mixed flow of ink flowing in from the plurality of first communication holes 5 has occurred. In the pressure chamber 4 having a small aspect ratio illustrated in FIG. 4B, there arise large variations in the flow velocity of ink in the pressure chamber 4 and particularly large variations in the flow velocity distribution on the energy generation element 1. On the other hand, in the pressure chamber 4 illustrated in FIG. 4C having a large aspect ratio, the flow velocity distribution of ink in the first direction W is more flattened. There are relatively small variations in the flow velocity distribution, and the flow velocity distribution is almost uniform particularly on the energy generation element 1. Therefore, even if an influence of the foaming pressure of the adjacent energy generation element 1 discontinuously occurs, temporal fluctuations in the flow velocity of ink, caused by the mixed flow, are reduced, making it possible to provide a more uniform flow velocity distribution of ink in the pressure chamber 4.

In the pressure chamber 4 having a relatively large aspect ratio, a larger resistance of the wall surface acts on ink. The large resistance of the wall surface in the pressure chamber 4 produces a rectified flow of ink to provide a more uniform flow velocity distribution of ink flowing into the pressure chamber 4. At the time of high-speed printing, since ink droplets are discharged in succession, the next ink droplet may be discharged before the flow velocity of ink in the pressure chamber 4 becomes zero. Even in this case, since a large region where the flow velocity distribution of ink is uniformized in the first direction W is allocated on the energy generation element 1 in the pressure chamber 4, the discharge velocity and discharge direction of ink droplets can be stabilized.

Although, in the configuration illustrated in FIGS. 4A to 4C, it is assumed that ink is discharged only from the discharge port A, ink droplets are actually discharged in succession from the plurality of discharge ports 3. The flow velocity distribution of ink supplied to the pressure chamber 4 is further disturbed and unstabilized by the influence of the pressure produced when ink is discharged from the adjacent discharge ports 3. However, in the pressure chamber 4 having a large aspect ratio according to the present exemplary embodiment, the flow of ink supplied to the pressure chamber 4 is rectified and accordingly a more uniform flow velocity distribution of ink is achieved on the energy generation element 1.

The aspect ratio of the pressure chamber 4 required to stably discharge ink droplets will be described below with reference to the configuration illustrated in FIGS. 2A and 2B. The dimensions of essential parts of the liquid discharge head 10 are as follows:

Length Dr of the energy generation element 1: 22 μm
Width Wr of the energy generation element 1: 18 μm
Diameter R of the discharge port 3: 20 μm
Width Wp of the pressure chamber 4: 37.3 μm
Sectional length Dh of the first communication hole 5: 19 μm
Sectional width Wh of the first communication hole 5: 19 μm
Height Hp of the liquid flow passage 6 and the pressure chamber 4 (height of the side walls 8): 9 μm
Length Ds of the first partition 7: 40 μm
Width Ws of the first partition 7: 5 μm
Distance Di between the side walls 8 on both sides: 100 μm
Thickness of the discharge port forming member 9: 7 μm The ink viscosity is assumed to be 3 cP, and the ink discharge amount (size of one ink droplet) is assumed to be 2 pL.

To enable stable ink discharge, it is necessary that a flow velocity distribution of ink which can be considered to be substantially uniform has been obtained on the width (Wr=17 μm) of the energy generation element 1.

An "equivalent flow velocity region" is used as a reference value representing the uniformity of the flow velocity distribution of ink which is required to achieve stable ink discharge. The "equivalent flow velocity region" is defined as the width of a region where the normalized flow velocity illustrated in FIG. 3 in the pressure chamber 4 is 0.95 or above. In other words, the length of the "equivalent flow velocity region" is equal to the length in the first direction W of the range where the flow velocity of ink is 95% of the maximum value or above in a section of the pressure chamber 4 which passes through the center of the discharge port 3, perpendicularly intersects with the first surface 2*a*, and is parallel to the first direction W. If the length of the "equivalent flow velocity region" is larger than the width Wr of the energy generation element 1, it becomes possible to obtain a flow velocity distribution of ink which can be considered to be approximately uniform on the energy generation element 1. As illustrated in FIGS. 4B and 4C, the flow velocity distribution of ink can be considered to be almost symmetric in the first direction W. Therefore, if the length of the "equivalent flow velocity region" is larger than the width Wr of the energy generation element 1, it is possible to obtain a flow velocity distribution of ink which can be considered to be approximately uniform over the total width of the energy generation element 1.

Figure 5:
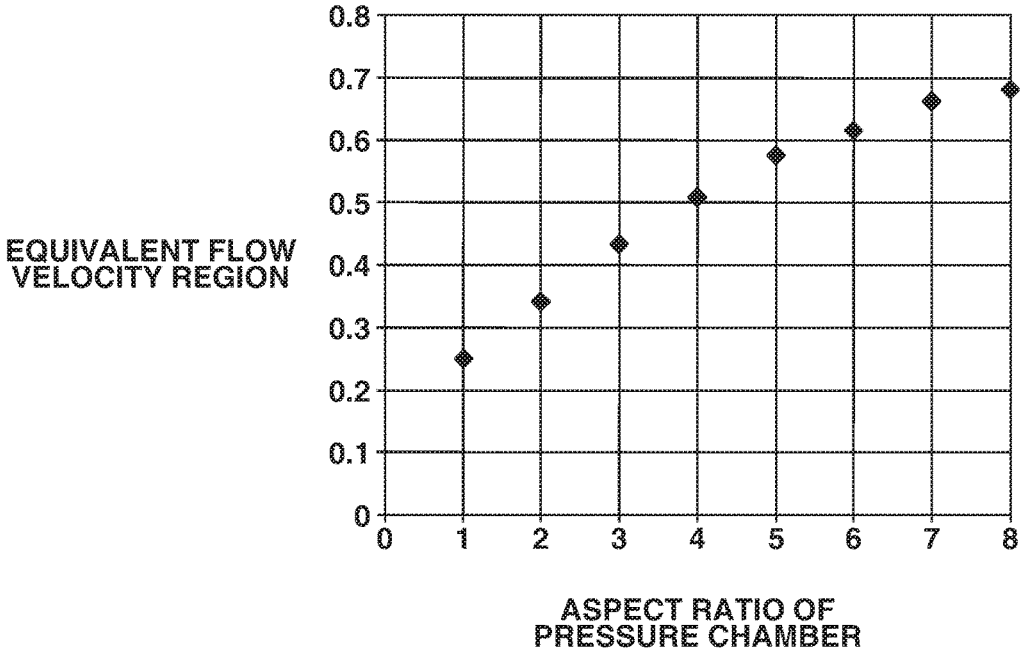
FIG. 5 illustrates a relation between the aspect ratio of the pressure chamber and an equivalent flow velocity region.

FIG. 5 illustrates a relation between the aspect ratio of the pressure chamber 4 and the equivalent flow velocity region. In the configuration illustrated in FIGS. 2A and 2B, since the width Wr of the energy generation element 1 is 18 μm and the width Wp of the pressure chamber 4 is 37.3 μm, the lower limit value of the equivalent flow velocity region required for stable ink discharge is Wr/Wp=0.48. Taking into consideration the tolerance in the manufacturing process of the print element substrate 2, the lower limit value of the equivalent flow velocity region is set to Wr/Wp=0.50. Referring to FIG. 5, when the aspect ratio of the pressure chamber 4 is 4.0 or above, the equivalent flow velocity region becomes 0.51 or above, making it possible to obtain a flow velocity distribution of ink which can be considered to be approximately uniform on the energy generation element 1. This means that, to make the length of the equivalent flow velocity region larger than the width Wr of the energy generation element 1, the aspect ratio of the pressure chamber 4 needs to be 4 (4.0) or above.

Although the equivalent flow velocity region required for stable ink discharge may depend on the width Wr of the energy generation element 1, the pressure chamber 4 needs to be equal to or larger than the minimum dimensions required to obtain the desired ink discharge amount. To obtain an ink discharge amount of 1 pL, it is necessary to secure an ink volume of about 10 μm×10 μm×10 μm equivalent to 1 pL in the pressure chamber 4. Taking the above-described aspect ratio into consideration, it is desirable that the height of the pressure chamber 4 is 10 μm or below. The width Wp of the pressure chamber 4 with which the flow velocity distribution of ink is uniformized for the required width Wr of the required energy generation element 1 can be set by setting the equivalent flow velocity region to about 0.5 and the lower limit value of the aspect ratio of the pressure chamber 4 to 4.0. If the aspect ratio of the pressure chamber 4 is 4.0 or above, variations in the flow velocity distribution of the liquid in the pressure chamber 4 decrease, making it possible to improve the landing accuracy. In addition to the above-described viewpoint of the aspect ratio, the flow velocity distribution may change with such parameters as the physical properties of the liquid including the liquid viscosity, and the ambient temperature. However, for variations in the flow velocity distribution, the above-described viewpoint of the aspect ratio is dominant, and such parameters as the physical properties of the liquid and the environmental temperature can be substantially ignored compared to the influence of the aspect ratio.

A form of a liquid discharge head more desirable for stable discharge of ink droplets will be described below. FIGS. 6A, 7A, 8A, 9A, 10A, 11A, 12A and 13A are similar to FIGS. 2A, and 6B, 7B, 8B, 9B, 10B, 11B, 12B and 13B are similar to FIG. 2B. More specifically, FIGS. 6A, 7A, 8A, 9A, 10A, 11A, 12A, and 13A are plan views illustrating the print element substrate 2, and FIGS. 6B, 7B, 8B, 9B, 10B, 11B, 12B, and 13B are sectional views taken along the line a1-a2 illustrated in FIGS. 6A, 7A, 8A, 9A, 10A, 11A, 12A, and 13A, respectively.

In the liquid discharge head 10 illustrated in FIG. 2A, the energy generation elements 1 are disposed with an arrangement density of 600 dpi, and the first communication holes 5 are disposed with an arrangement density of 600 dpi along with the energy generation elements 1 on one side of the row of the energy generation elements 1. The same numbers of the energy generation elements 1 and the first communication holes 5 are disposed at equal pitches. The straight line connecting the center of the energy generation element 1 and the center of the first communication hole 5 is parallel to the second direction D. The center position of the communication hole row including the plurality of first communication holes 5 in the first direction W coincides with the center position of the pressure chamber row including the plurality of pressure chambers 4 in the first direction W. This increases the amount of velocity component in the second direction D in the flow of ink flowing into the pressure chamber 4, thereby making it possible to minimize the disturbance of the flow velocity distribution of ink in the pressure chamber 4.

The flow passage sectional area of the pressure chamber 4 (flow passage area in the section perpendicularly intersecting with the second direction D) is smaller than the minimum flow passage sectional area of the first communication hole 5, (minimum flow passage area in a section perpendicularly intersecting with the third direction H). Since the flow velocity of ink in the pressure chamber 4 is larger than the flow velocity of ink in the first communication hole 5, the stagnation region of ink in the pressure chamber 4 decreases, thereby making it possible to uniformize the flow velocity distribution of ink to a further extent. This configuration is also effective in a case of providing a bending portion or dead-end portion in the ink flow passage because of restrictions of the manufacturing process of the print element substrate 2 or to prevent pressure propagation between the adjacent discharge ports 3.

Figure 6A:
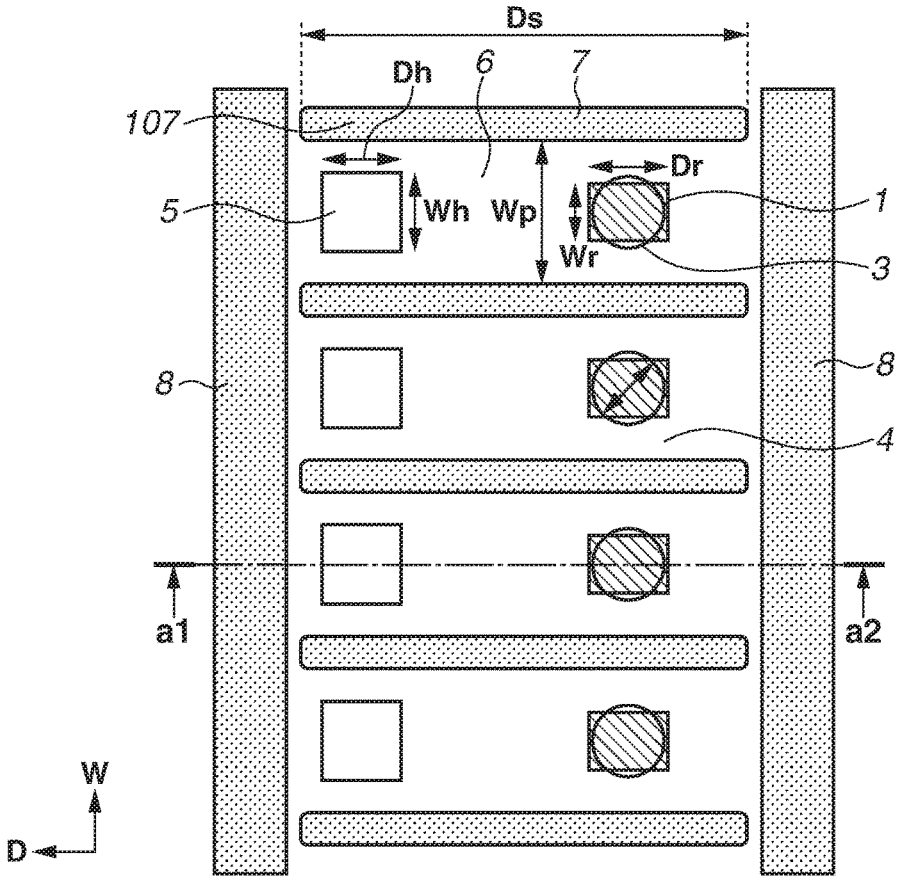
FIGS. 6A and 6B are schematic views illustrating a print element substrate according to a modification of the first exemplary embodiment.
Figure 6B:
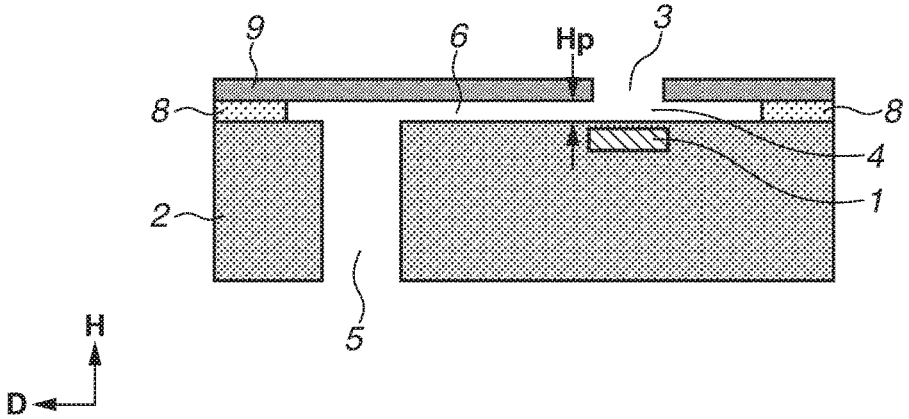
Figure 7A:
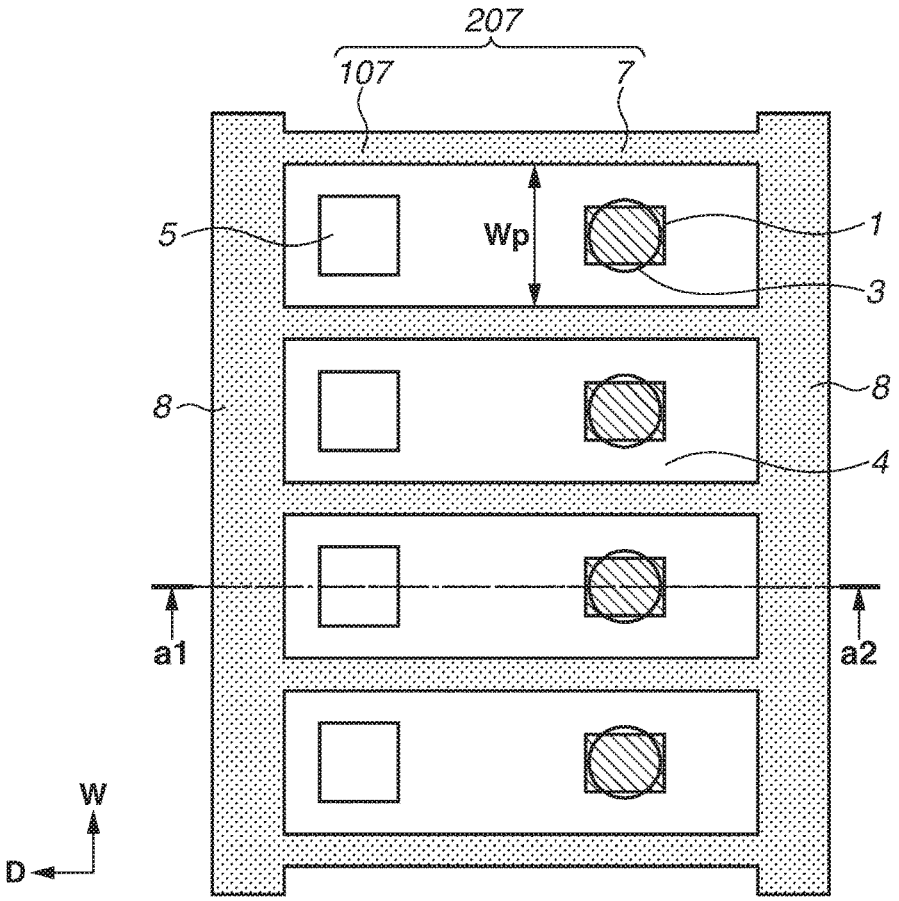
FIGS. 7A and 7B are schematic views illustrating a print element substrate according to another modification of the first exemplary embodiment.
Figure 7B:
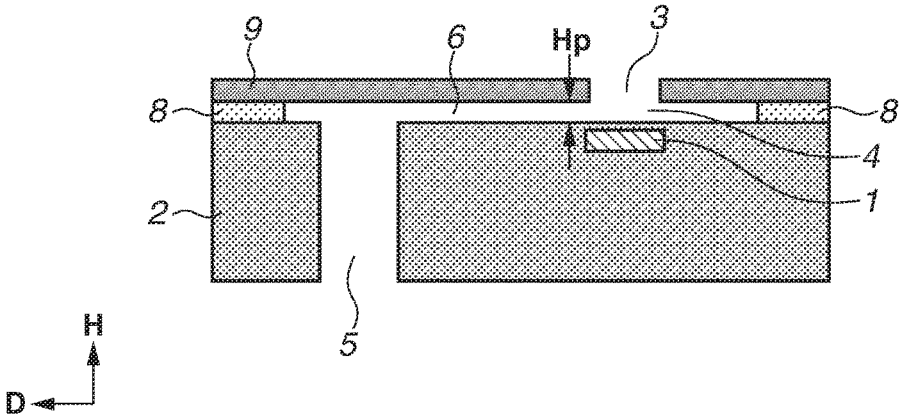

FIGS. 6A and 6B illustrate a modification of the liquid discharge head 10 according to the present exemplary embodiment. A second partition 107 is formed between the adjacent first communication holes Although the second partition 107 is integrally formed with the first partition 7, the second partition 107 may be separated from the first partition 7. FIGS. 7A and 7B illustrate another modification of the liquid discharge head 10 according to the present exemplary embodiment. The integrally formed first partition 7 and second partition 107 (partition 207), together with the two side walls 8, completely partition the first communication hole 5 and the pressure chamber from other first communication holes 5 and pressure chambers 4. The liquid flow passage 6 and the pressure chamber 4 have the same flow passage width Wp and the same flow passage height Hp, and both the liquid flow passage 6 and the pressure chamber 4 satisfy the condition that the aspect ratio is Wp/Hp≥4. These modifications are effective when pressure vibration by the ink discharge in the adjacent pressure chambers 4 or variations in the amount of ink supply from the first communication hole 5 cause a problem on the required discharge accuracy.

Figure 8A:
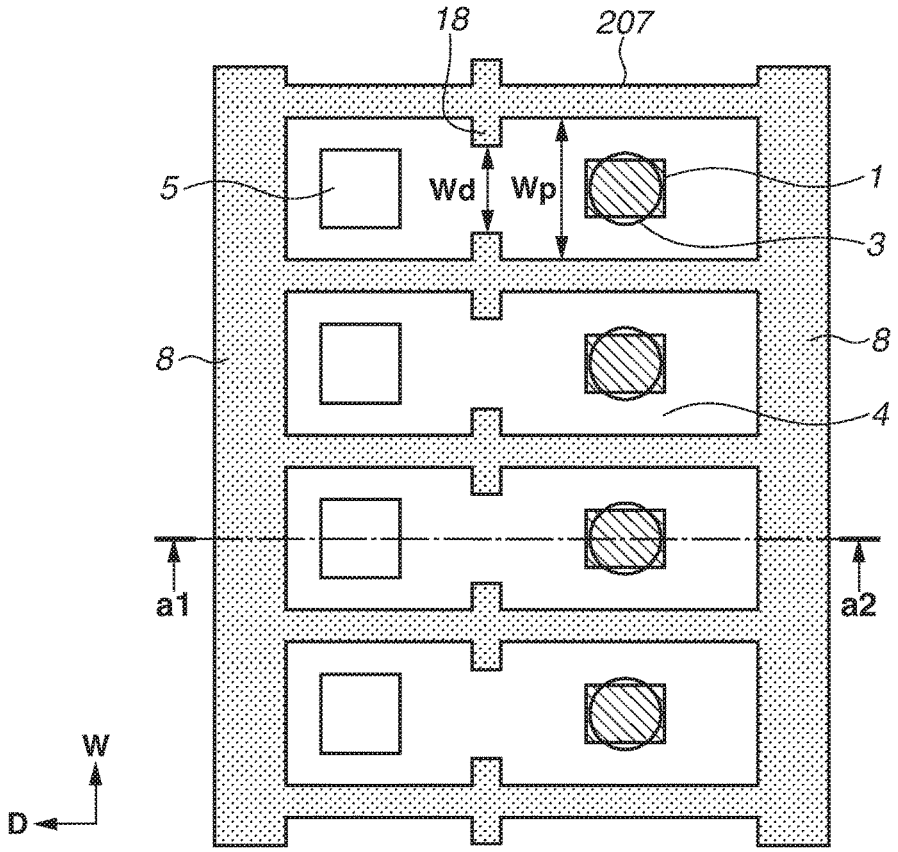
FIGS. 8A and 8B are schematic views illustrating a print element substrate according to yet another modification of the first exemplary embodiment.
Figure 8B:
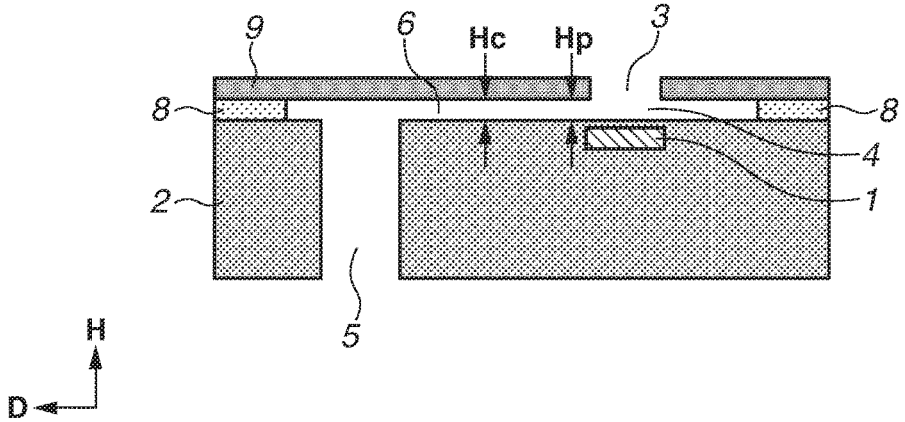

FIGS. 8A and 8B illustrate yet another modification of the liquid discharge head 10 according to the present exemplary embodiment. There are provided two projections 18 projected from the partitions 207 on both sides toward the liquid flow passage 6. Desirably, the two projections 18 have the same shape and are disposed at the same position in the second direction D. The projections 18 are positioned between the energy generation element 1 and the first communication hole 5. The projections 18 prevent the discharge pressure generated in the pressure chamber 4 from being diffused toward the first communication hole 5. The pressure chamber 4 satisfies the condition that the aspect ratio is Wp/Hp≥4. Desirably, a more uniform flow velocity distribution of ink is achieved when the condition that the aspect ratio is Wd/Hp≥4 is satisfied between the two projections 18 providing the minimum flow passage width Wd.

Figure 9A:
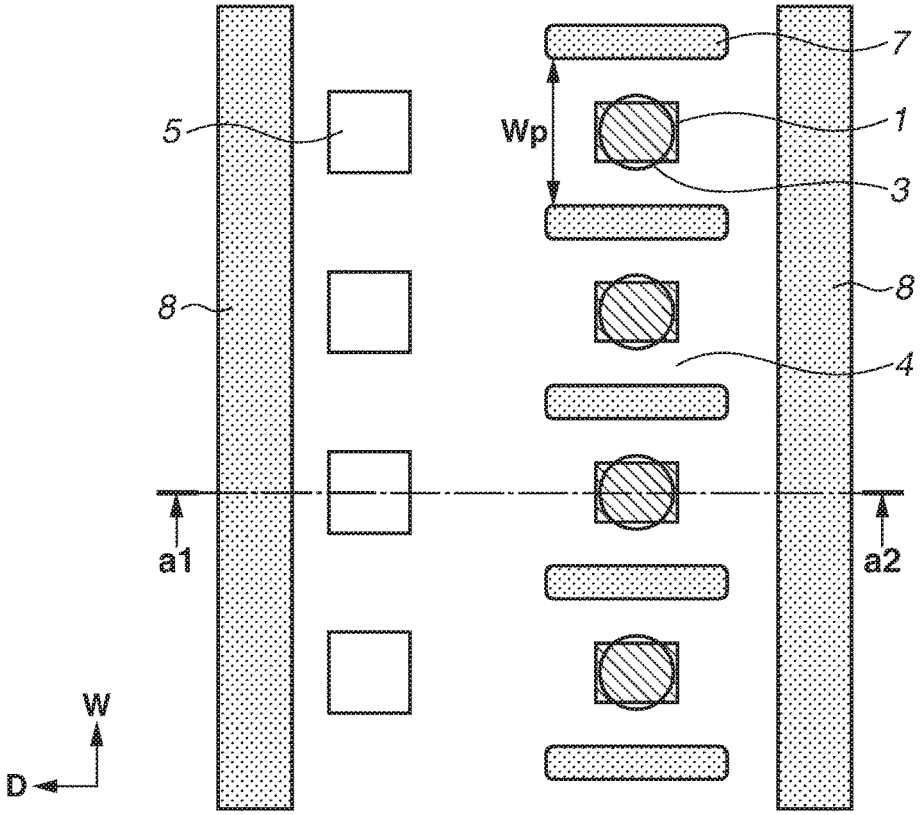
FIGS. 9A and 9B are schematic views illustrating a print element substrate according to yet another modification of the first exemplary embodiment.
Figure 9B:
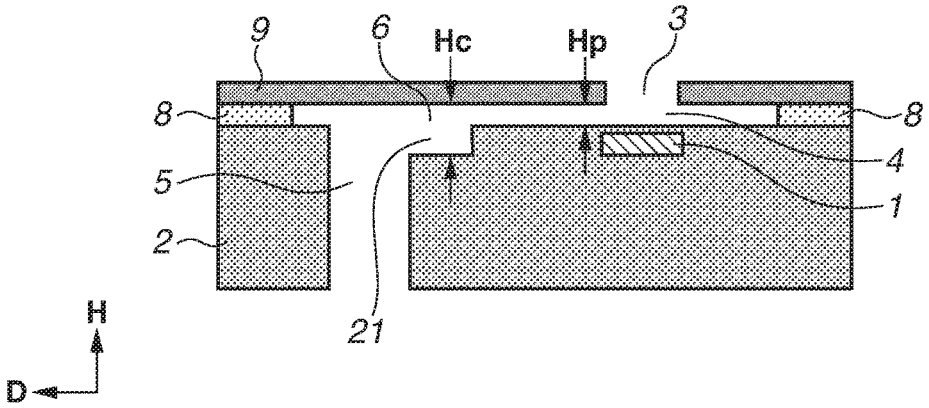

FIGS. 9A and 9B illustrate yet another modification of the liquid discharge head 10 according to the present exemplary embodiment. A level difference 21 is formed in the liquid flow passage 6, and the height of the liquid flow passage 6 in the vicinity of the first communication hole 5 is larger than that at the entrance of the pressure chamber 4. The shape of the level difference 21 is not limited thereto as long as the height of the liquid flow passage 6 in the third direction H differs at two or more positions along the liquid flow passage 6. Further, a smooth curved surface may be disposed instead of a level difference. Although the liquid flow passage 6 illustrated in FIGS. 9A and 9B can supply a larger amount of ink to the pressure chamber 4, the flow of ink is likely to be disturbed. However, a more uniform flow velocity distribution of ink is achieved on the energy generation element 1 when the pressure chamber 4 satisfies the condition that the aspect ratio is Wp/Hp≥4.

Figure 10A:
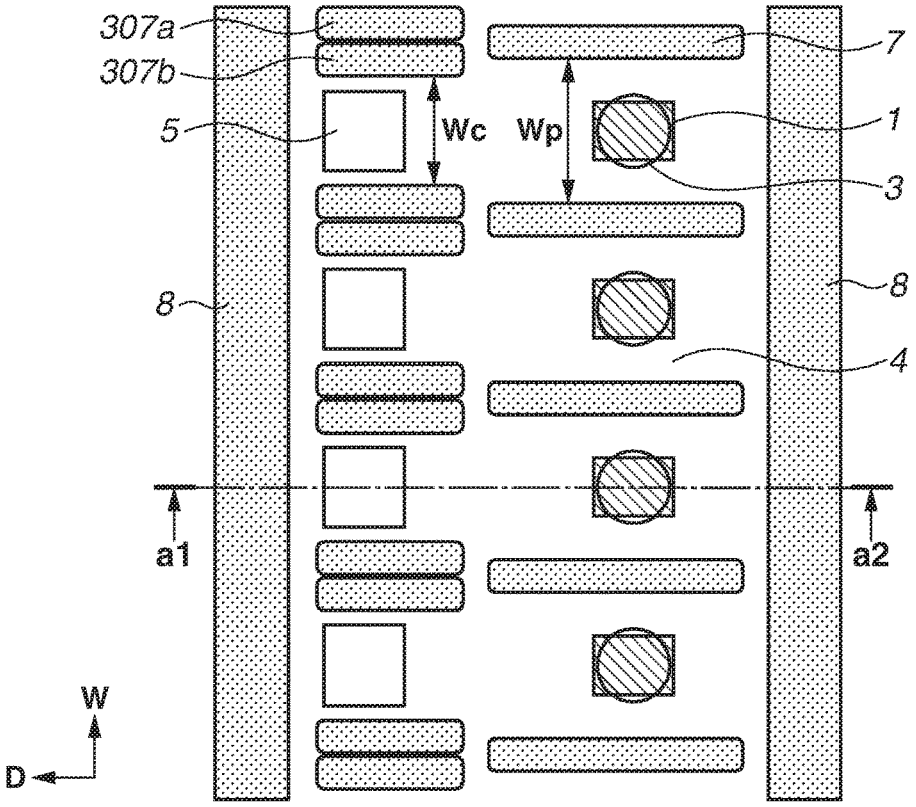
FIGS. 10A and 10B are schematic views illustrating a print element substrate according to yet another modification of the first exemplary embodiment.
Figure 10B:
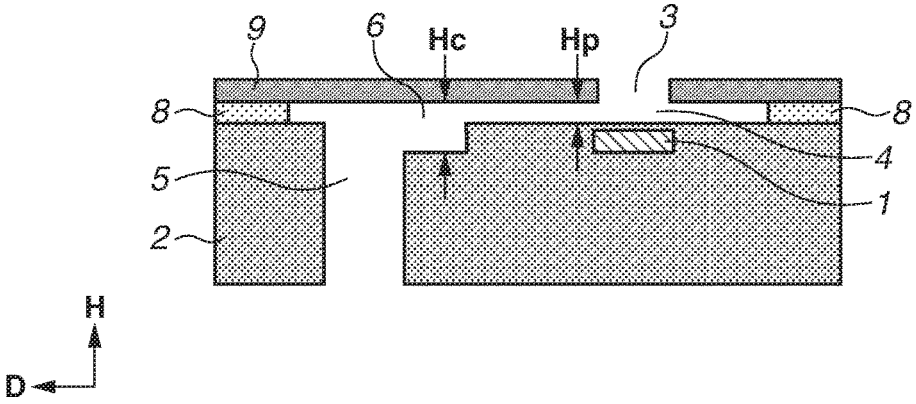

FIGS. 10A and 10B illustrate yet another modification of the liquid discharge head 10 according to the present exemplary embodiment. Two second partitions 307*a* and 307*b* are formed between the adjacent first communication holes 5. The number of the second partitions 307*a* and 307*b* disposed between the adjacent first communication holes 5 is not limited thereto. Although the second partitions 307*a* and 307*b* are separated from the first partition 7, the second partitions 307*a* and 307*b* may be integrally formed with the first partition 7. Since the discharge port forming member 9 can be supported not only by the first partition 7 and the side walls 8 but also by the second partitions 307*a* and 307*b*, it is possible to prevent deformation of the discharge port forming member by an external force or swelling. Also in the present exemplary embodiment, the flow passage width Wp and the flow passage height Hp satisfy the condition that the aspect ratio is Wp/Hp≥4.

Figure 11A:
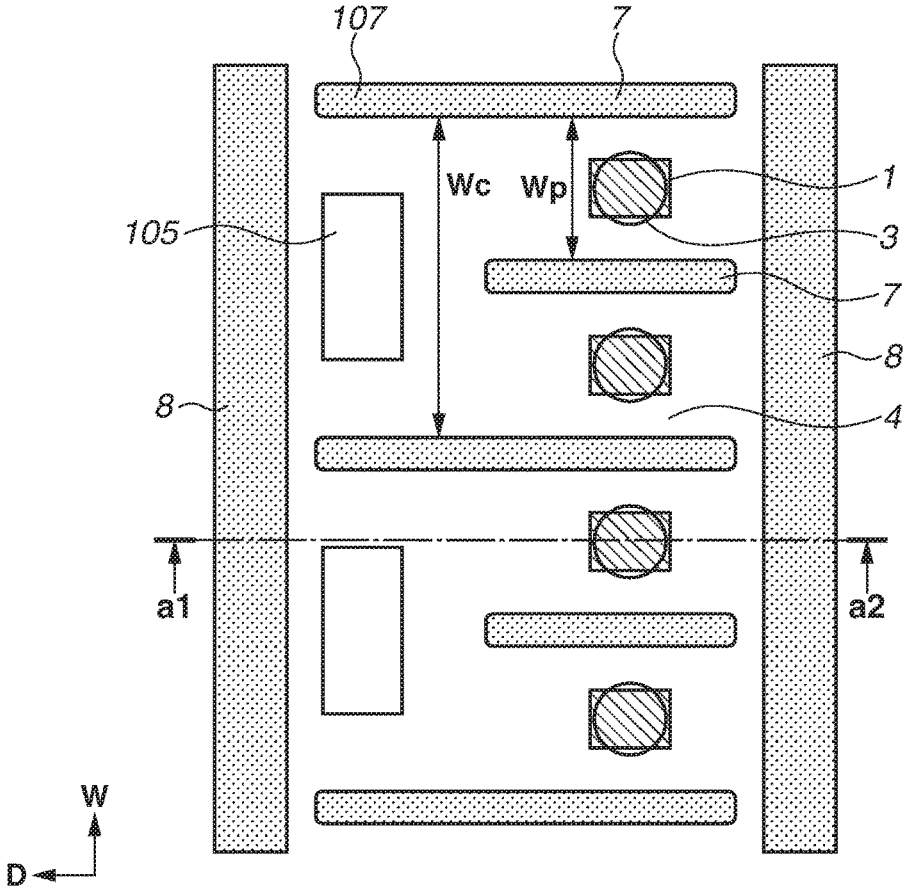
FIGS. 11A and 11B are schematic views illustrating a print element substrate according to yet another modification of the first exemplary embodiment.
Figure 11B:
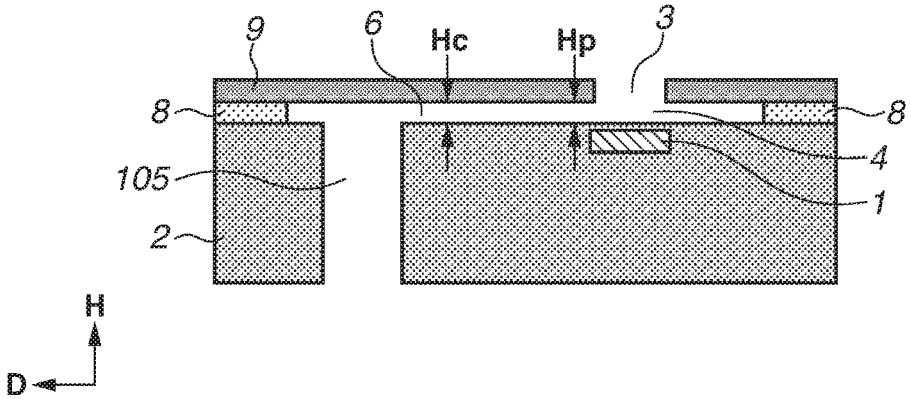

FIGS. 11A and 11B illustrate yet another modification of the liquid discharge head 10 according to the present exemplary embodiment. The arrangement distance between the first communication holes 5 is larger than the arrangement distance between the energy generation elements 1. A plurality of pressure chambers 4 (two pressure chambers 4 according to present exemplary embodiment) is assigned to one first communication hole 5. According to the present modification, the discharge ports 3 can be formed with a resolution (arrangement density) higher than the restriction of the process resolution for forming the first communication holes 5. Since ink supplied from the first communication hole 5 flows into the two pressure chambers 4 in an oblique direction, a disturbance of the flow velocity distribution of ink in the pressure chamber 4 is likely to occur. However, the uniformization of the flow velocity distribution of ink can be achieved by setting the aspect ratio of the pressure chamber 4 to Wp/Hp≥4.

In the above-described line type liquid discharge heads 10 according to the present exemplary embodiment and modifications, ink is supplied from a common ink tank to the long liquid discharge heads 10. Therefore, the length of the flow passage from the ink tank to the first communication hole 5 largely differ for each first communication hole 5, and a difference is likely to occur in the pressure of ink supplied to the first communication hole 5. However, setting the aspect ratio of the pressure chamber 4 to Wp/Hp≥4 enables uniformizing the flow velocity distribution of ink and preventing variations in the landing position of ink droplets even in a line type liquid discharge head having a number of discharge ports 3.

A second exemplary embodiment will be described below. The basic configuration of the liquid discharge head according to the present exemplary embodiment is similar to that according to the first exemplary embodiment, and therefore only characteristic configurations will be described below.

Figure 12A:
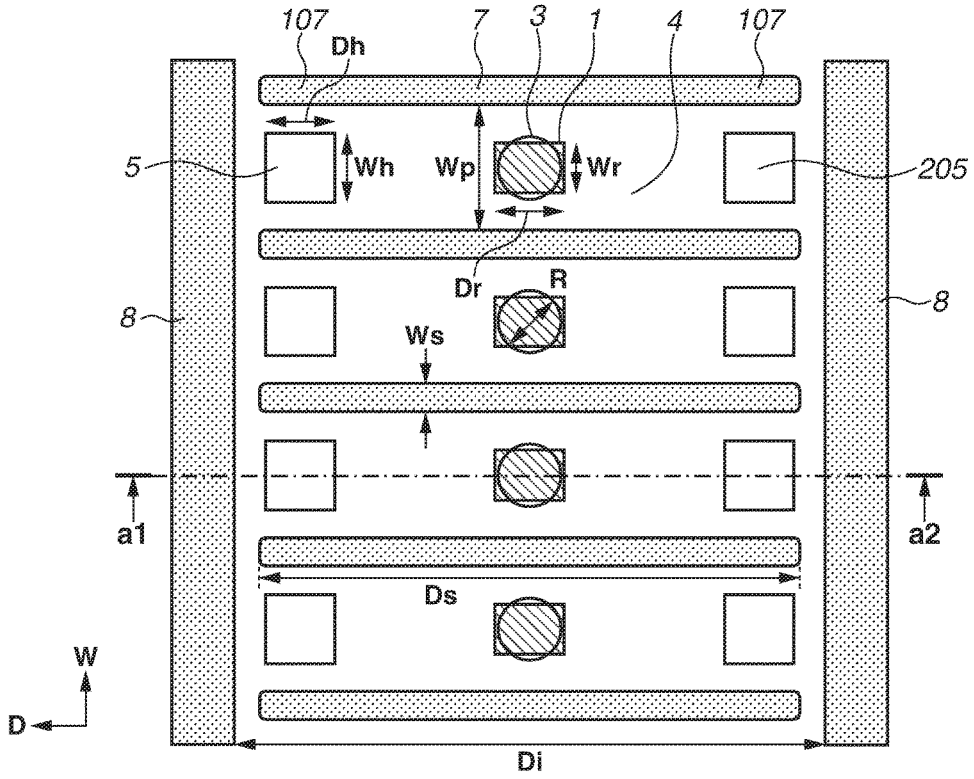
FIGS. 12A and 12B are schematic views illustrating a print element substrate according to a second exemplary embodiment of the present disclosure.
Figure 12B:
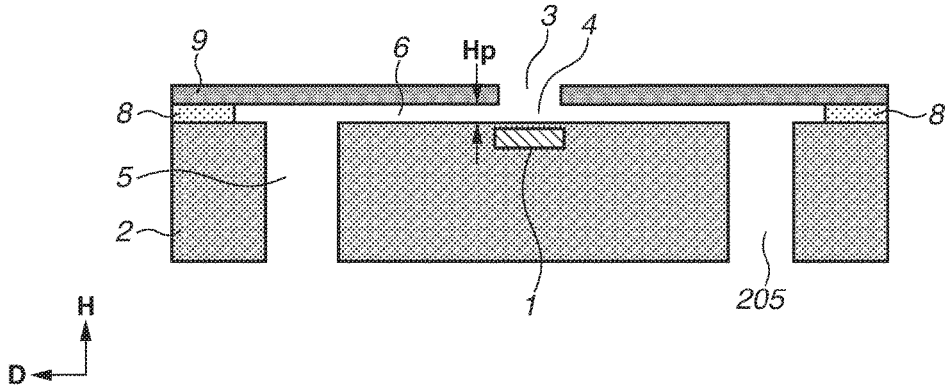

Referring to FIGS. 12A and 12B, the liquid discharge head 10 is provided with a second communication hole 205 which penetrates the print element substrate 2 on the opposite side of the first communication hole 5 relative to the pressure chamber 4 to communicate with the pressure chamber 4. The energy generation elements 1 are disposed with an arrangement density of 600 dpi. The first communication holes 5 and the second communication holes 205 are disposed on respective sides of the energy generation elements 1 with an arrangement density of 600 dpi. The liquid discharge head 10 is a line type liquid discharge head having a printing width of 430 mm, and is composed of a plurality of print element substrates 2 disposed in series, each of which includes 256 to 2048 or a larger number of discharge ports 3 per unit.

The first partitions 7 are formed on both sides of the pressure chamber 4 in the first direction W. The second partition 107 is formed between the adjacent first communication holes 5 and between the adjacent second communication holes 205 in the first direction W. Although the first partition 7 and the second partition 107 are integrally formed to be continuous from the first communication hole 5 to the second communication hole 205, the first partition 7 and second partition 107 may be separated. The dimensions of essential parts of the liquid discharge head 10 according to the present exemplary embodiment are as follows:

Length Dr of the energy generation element 1: 20 μm
Width Wr of the energy generation element 1: 15 μm
Diameter R of the discharge port 3: 20 μm
Width Wp of the pressure chamber 4: 37.3 μm
Sectional length Dh of the communication holes 5 and 205: 20 μm
Sectional width Wh of the communication holes 5 and 205: 20 μm
Height Hp of the liquid flow passage 6 and the pressure chamber 4 (height of the side walls 8): 8 μm
Length Ds of the partition (total length of the partitions 7 and 107): 140 μm
Width Ws of the partitions 7 and 107: 5 μm
Distance Di between the side walls 8 on both sides: 160 μm
Thickness of the discharge port forming member 9: 6 μm In the liquid discharge head 10 according to the present exemplary embodiment, the lower limit value of the equivalent flow velocity region can be secured by setting the aspect ratio Wp/Hp of the pressure chamber 4 to 4.66 or above. The first communication hole 5 and the second communication hole 205 are formed on both sides of the pressure chamber 4, and ink is supplied from both sides of the pressure chamber 4. Therefore, the symmetry of the flow velocity distribution of ink on both sides of the discharge port 3 improves, and ink stably flows along the second direction D. These effects enable further improving the landing accuracy of ink droplets. Since ink is supplied from two directions, the liquid discharge head. 10 according to the present exemplary embodiment can be driven at high speed.

According to the present exemplary embodiment, the minimum height of the liquid flow passage 6 is made smaller than the maximum diameter of the discharge port 3. Therefore, even if foreign substances appear or flow in the liquid flow passage 6, foreign substances larger than the maximum diameter of the discharge port 3 are not supplied to the pressure chamber 4. This enables preventing non-discharge by clogging of foreign substances in the discharge port 3 to prevent variations in the landing position of ink droplets.

A third exemplary embodiment will be described below. The basic configuration of the liquid discharge head 10 according to the present exemplary embodiment is similar to that according to the second exemplary embodiment, and therefore only characteristic configurations will be described below.

Figure 13A:
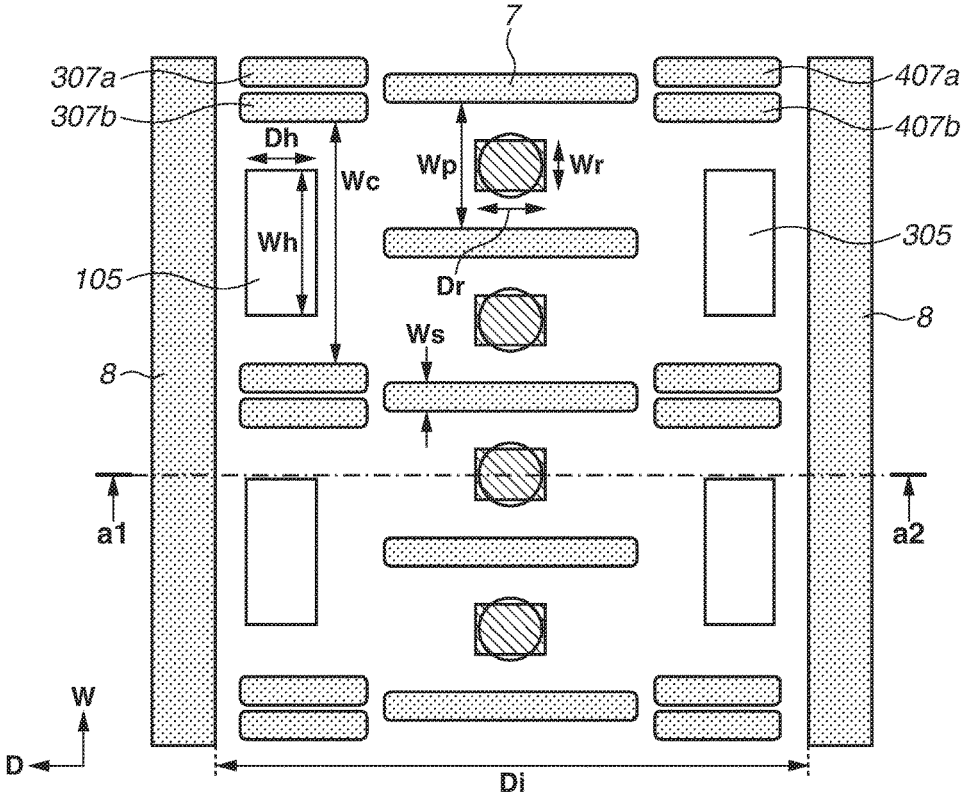
FIGS. 13A and 13B are schematic views illustrating a print element substrate according to a third exemplary embodiment of the present disclosure.
Figure 13B:
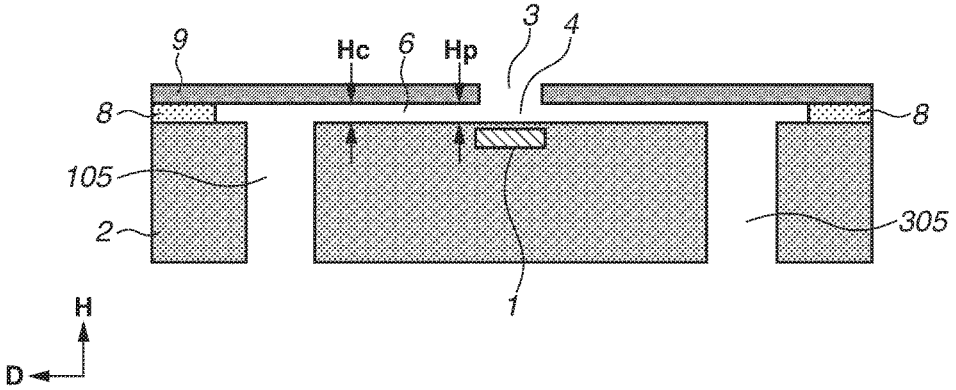

FIGS. 13A and 13B illustrate a configuration of the print element substrate 2 of the liquid discharge head 10 according to the present exemplary embodiment. In the liquid discharge head 10 according to the present exemplary embodiment, ink in the pressure chamber 4 circulates from the first communication hole 105 toward the second communication hole 305. Therefore, a liquid discharge apparatus having the liquid discharge head 10 according to the present exemplary embodiment includes a unit configured to circulate ink in the pressure chambers 4 between the inside and outside of the pressure chambers 4. Although, in the present exemplary embodiment, ink is circulated between the ink tank and the liquid discharge head 10, it is possible that two tanks are provided respectively on the upstream and downstream sides of the liquid discharge head 10, and ink in the pressure chamber 4 is circulated by flowing ink from one ink tank to the other.

The dimensions of essential parts of the liquid discharge head 10 according to the present exemplary embodiment are as follows:

Sectional length Dh of the communication hole: 20 μm
Width Wh of the communication hole: 50 μm
Length Ds of the first partition 7: 80 μm
Width Ws of the first partition 7: 5 μm
Length Ds of the second partitions 307*a*, 307*b*, 407*a*, and 407*b*: 30 μm
Width Ws of the second partitions 307*a*, 307*b*, 407*a*, and 407*b*: 4 μm
Distance Di between the side walls 8 on both sides: 160 μm Two second partitions 307*a* and 307*b* are formed between the first communication holes 105, and the two second partitions 407*a* and 407*b* are formed between the second communication holes 305. Although the second partitions 307*a*, 307*b*, 407*a*, and 407*b* are separated from the first partition 7, they may be integrally formed with the first partition 7. Since the discharge port forming member 9 can be supported not only by the first partitions 7 and the side walls 8 but also by the second partitions 307*a*, 307*b*, 407*a*, and 407*b*, the discharge port forming member 9 can be prevented from being deformed by an external force or swelling.

The arrangement distance between the first communication holes 105 and between the second communication holes 305 is larger than the arrangement distance between the energy generation elements 1. A plurality of pressure chambers 4 (two pressure chambers 4 according to the present exemplary embodiment) is assigned to one first communication hole 105 and one second communication hole 305. According to the present exemplary embodiment, the discharge ports 3 can be formed with a resolution (arrangement density) higher than the restriction of the process resolution for forming the first communication holes 105 and the second communication holes 305. Since ink supplied from the first communication hole 105 and the second communication hole 305 flows toward the two pressure chambers 4 in an oblique direction, a disturbance of the flow velocity of ink in the pressure chamber 4 is likely to occur. However, the uniformization of the flow velocity distribution of ink can be achieved by setting the aspect ratio of the pressure chamber 4 to Wp/Hp≥4.

Figure 14:
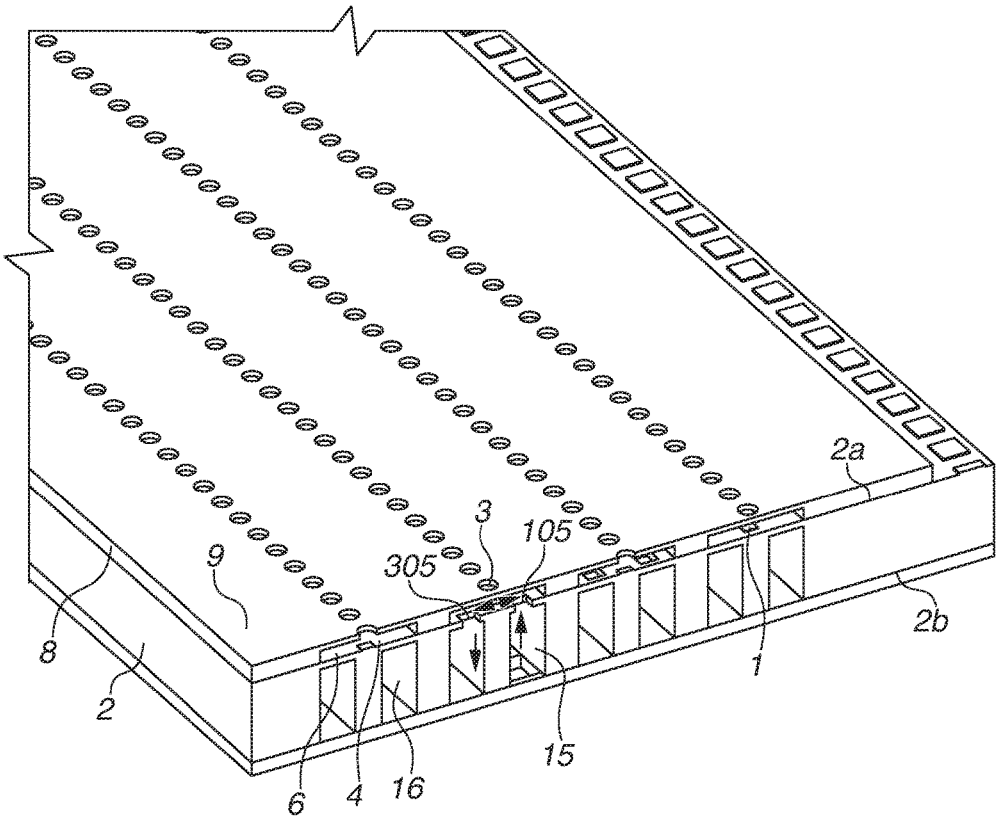
FIG. 14 is an enlarged perspective view illustrating a part of the print element substrate illustrated in FIGS. 13A and 13B.

FIG. 14 is an enlarged perspective view illustrating a part of the liquid discharge head 10 according to the present exemplary embodiment, and illustrating ink supply and discharge passages. A first common flow passage 15 and a second common flow passage 16 are formed on the side of the second surface 2*b* of the print element substrate 2. Ink is constantly flowing in the first common flow passage 15 and the second common flow passage 16. Part of ink flowing in the first common flow passage 15 is supplied to the pressure chamber 4 via the first communication hole 105. Ink supplied to the pressure chamber 4 is discharged to the second common flow passage 16 via the second communication hole 305. A flow of ink from the first common flow passage 15 to the second common flow passage 16 is obtained by the pressure difference between the first common flow passage 15 and the second common flow passage 16. Therefore, when ink is being discharged by the liquid discharge head 10, a flow of ink occurs also in the pressure chamber 4 with which ink is not being discharged, and thickened ink and foreign substances in ink are discharged to the second common flow passage 16. Thus, stagnation and thickening of ink in the pressure chamber 4 and the discharge port 3 can be prevented. According to the discharge frequency and the ink discharge amount from the surrounding discharge ports it is possible to switch between a state where ink flows from the first common flow passage 15 to the second common flow passage 16 and a state where ink is supplied from both of the first common flow passage 15 and the second common flow passage 16 to the pressure chamber 4.

According to the present exemplary embodiment, the flow passage configuration for ink circulation enables maintaining a state where the ink characteristics have small variations and obtaining stable discharge performance from the first discharge of ink droplets. Further, since thickened ink does not easily stagnate in the pressure chamber 4, variations in the landing position of ink droplets can be prevented as in the second exemplary embodiment.

In the modifications of the present exemplary embodiment, ink can be circulated by using a bimor pump or tube pump. When using these pumps, a pulsation of ink may be caused by the pump output. According to the present exemplary embodiment, since the pressure chamber 4 has a similar function to a damper, ink supplied to the pressure chamber 4 is subjected to rectification effects by the resistance of the wall surface. Therefore, temporal fluctuations in the flow velocity of ink by a pulsation of ink can be reduced. As a result, it is possible to reduce fluctuations in the flow velocity of ink resulting from the pulsation flow of ink by the pump output, thus preventing temporal variations in the landing position of ink droplets.

Further, when starting the ink circulation, for example, when starting the operation of a liquid discharge apparatus, it is possible to circulate ink of which the viscosity has been increased by the volatilization from the discharge ports 3 to replace the almost entire region in the pressure chamber 4 with a flow of ink having a uniformized flow velocity distribution. Thus, the time required to stably discharge ink droplets can be shortened.

A fourth exemplary embodiment will be described below. The basic configuration of the liquid discharge head 10 according to the present exemplary embodiment is similar to that according to the third exemplary embodiment, and therefore only characteristic configuration will be described below with reference to FIGS. 13A and 13B.

The energy generation elements 1 are disposed with an arrangement density of 1200 dpi.

The dimensions of essential parts of the liquid discharge head 10 according to the present exemplary embodiment are as follows:

Length Dr of the energy generation element 1: 18 μm
Width Wr of the energy generation element 1: 10 μm
Diameter R of the discharge port 3: 15 μm
Width Wp of the pressure chamber 4: 17.7 μm
Sectional length Dh of the communication holes 105 and 305: 20 μm
Width Wh of the communication holes 105 and 305: 30 μm
Height Hp of the liquid flow passage 6 and the pressure chamber 4 (height of the side walls 8): 3.5 μm
Length Ds of the first partition 7: 70 μm
Width Ws of the first partition 7: 3.5 μm
Length Ds of the second partitions 307*a*, 307*b*, 407*a*, and 407*b*: 30 μm
Width Ws of the second partitions 307*a*, 307*b*, 407*a*, and 407*b*: 3.5 μm
Distance Di between the side walls 8 on both sides: 150 μm
Thickness of the discharge port forming member 9: 4 μm
The ink viscosity is assumed to be 2 cP, and the ink discharge amount is assumed to be 1 pL.

According to the present exemplary embodiment, the lower limit value of the equivalent flow velocity region is Wr/Wp=0.56. Referring to FIG. 5, when the aspect ratio of the pressure chamber 4 is 5.0 or above, the equivalent flow velocity region becomes 0.57 or above, making it possible to obtain a flow velocity distribution of ink which can be considered to be approximately uniform on the energy generation element 1. As a result, variations in the landing position of ink droplets can be prevented.

According to the present disclosure, it is possible to provide a liquid discharge head having a more uniformized flow velocity distribution of the liquid in the pressure chamber.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2016-137371, filed Jul. 12, 2016, which is hereby incorporated by reference herein in its entirety.

What is claimed is:

1. A liquid discharge head comprising:

print element substrate provided with a plurality of energy generation elements configured to apply energy for discharging a liquid;

a discharge port forming member provided with a plurality of discharge ports which face the energy generation elements and are configured to discharge the liquid; and a plurality of first partitions which extend between the print element substrate and the discharge port forming member, and are configured to partition pressure chambers including the energy generation elements, wherein the plurality of energy generation elements is disposed in a first direction on a first surface of the print element substrate, and wherein a ratio of a distance between the first partitions in the first direction to a height of the pressure chamber in a direction perpendicular to the first surface is 4 or above.

2. The liquid discharge head according to claim 1, wherein the height of the pressure chamber is 10 μm or below.

3. The liquid discharge head according to claim 1, wherein the plurality of first partitions extends in a second direction which is parallel to the first surface and perpendicularly intersects with the first direction, and wherein a length of the first partition is larger than dimension of the energy generation element in the second direction.

4. The liquid discharge head according to claim 1, wherein the liquid discharge head includes a plurality of first communication each of which penetrates the print element substrate and communicates with the pressure chamber to supply the liquid to the pressure chamber, and wherein a flow passage sectional area of the pressure chamber is smaller than a minimum flow passage sectional area of the first communication holes.

5. The liquid discharge head according to claim 4, wherein the plurality of first communication holes is disposed in the first direction, and wherein an arrangement distance between the plurality of first communication holes is larger than an arrangement distance between the plurality of energy generation elements.

6. The liquid discharge head according to claim 4, wherein the liquid discharge head includes a liquid flow passage for connecting the first communication hole to the pressure chamber to supply the liquid to the pressure chamber, and projections projected from the first partition into the liquid flow passage.

7. The liquid discharge head according to claim 4, wherein the liquid discharge head includes a liquid flow passage for connecting the first communication hole to the pressure chamber to supply the liquid to the pressure chamber, and wherein a minimum height of the liquid flow passage in a direction perpendicular to the first surface is smaller than a maximum diameter of the discharge port.

8. The liquid discharge head according to claim 4, wherein the liquid discharge head includes a liquid flow passage for connecting the first communication hole to the pressure chamber to supply the liquid to the pressure chamber, and wherein a height of the liquid flow passage in a direction perpendicular to the first surface differs at different positions along the liquid flow passage.

9. The liquid discharge head according to claim 4, wherein a center position in the first direction of communication hole row composed of the plurality of first communication holes coincides with a center position in the first direction of a discharge port row composed of the plurality of discharge ports.

10. The liquid discharge head according to claim 4, wherein the liquid discharge head includes second communication holes each of which penetrates the print element substrate and communicates with the pressure chamber on an opposite side of the first communication holes relative to the pressure chamber.

11. The liquid discharge head according to claim 4, wherein a second partition is disposed between the adjacent first communication holes.

12. The liquid discharge head according to claim 11, wherein a plurality of the second partitions is disposed between the adjacent first communication holes.

13. The liquid discharge head according to claim 11, wherein the second partition is separated from the first partition.

14. The liquid discharge head according to claim 11, wherein the second partition is integrally formed with the first partition.

15. The liquid discharge head according to claim 1, wherein the liquid in the pressure chamber is circulated to/from an outside of the pressure chamber.

16. The liquid discharge head according to claim 1, wherein the energy generation elements are heating elements which generate air bubbles in the liquid to discharge the liquid.

17. The liquid discharge head according to claim 1, wherein the liquid discharge head comprises a plurality of print element substrate, at least one of which is the print element substrate.

18. The liquid discharge head according to claim 17, wherein the print element substrates are disposed along a straight line in a longitudinal direction of the liquid discharge head.

* * * * *